US005545482A

United States Patent [19]

Yamaoka et al.

[11] Patent Number: 5,545,482

[45] Date of Patent: Aug. 13, 1996

[54] TWO-PHASE STAINLESS STEEL WIRE ROPE HAVING HIGH FATIGUE RESISTANCE AND CORROSION RESISTANCE

[75] Inventors: Yukio Yamaoka, Sakai; Kishio Tamai, Amagasaki; Hiroshi Masutani, Izumisano, all of Japan

[73] Assignee: Shinko Kosen Kogyo Kabushiki Kaisha, Amagasaki, Japan

[21] Appl. No.: 357,994

[22] Filed: Dec. 16, 1994

Related U.S. Application Data

[63] Continuation of Ser. No. 34,893, Mar. 19, 1993, abandoned.

[30] Foreign Application Priority Data

Jul. 1, 1992 [JP] Japan ..... 4-174459
Feb. 17, 1993 [JP] Japan ..... 5-027729

[51] Int. Cl.[6] ..... B32B 15/00

[52] U.S. Cl. ..... 428/379; 428/367; 428/397; 428/685; 428/659; 148/327; 148/325; 420/52; 420/57; 420/67

[58] Field of Search ..... 428/379, 367, 428/397, 685, 684, 683, 659, 567, 667; 148/595,597, 605, 607, 608, 609, 611, 325, 326, 327; 420/34, 38, 43, 52, 57, 67; 266/200; 75/304, 319

[56] References Cited

U.S. PATENT DOCUMENTS

| | | | |
|---|---|---|---|
| 3,513,251 | 5/1970 | Schoerner et al. | 170/110 |
| 3,515,251 | 5/1970 | Schoerner | 428/379 |
| 3,567,434 | 3/1971 | Richardson et al. | 75/125 |
| 3,839,100 | 10/1974 | Ota | 148/37 |
| 3,936,297 | 2/1976 | Harltine, III | 75/130.5 |
| 4,141,762 | 2/1979 | Yamaguchi et al. | 148/37 |
| 4,391,635 | 7/1983 | Murakami et al. | 75/125 |
| 4,605,598 | 8/1986 | Thomas et al. | 428/379 |
| 4,770,935 | 9/1988 | Yamamura et al. | 428/379 |
| 4,791,025 | 12/1988 | Hiromori et al. | 428/379 |
| 4,816,085 | 3/1989 | Flasche et al. | 148/327 |

*Primary Examiner*—Patrick J. Ryan
*Assistant Examiner*—Merrick Dixon
*Attorney, Agent, or Firm*—Oblon, Spivak, McClelland, Maier & Neustadt, P.C.

[57] ABSTRACT

A two-phase stainless steel wire rope having a high fatigue resistance and a high corrosion resistance, containing two-phase stainless steel wires of 0.03 to 0.1% by weight of C, 0.33 to 1.0% by weight of Si, 0.65 to 1.5% by weight of Mn, 0.019 to 0.04% by weight P, 0.004 to 0.03% by weight of S, 18.21 to 30% by weight of Cr, 3.10 to 8.0% by weight of Ni, 0.1 to 3.0% by weight of Mo, with the balance being Fe, and 30.0 to 80.0% by volume of ferrite, which wire rope has a means slenderness ratio, $M_R$, of 4 to 20 by wire drawing.

2 Claims, 3 Drawing Sheets

TWO-PHASE STAINLESS STEEL WIRE ROPE HAVING HIGH FATIGUE RESISTANCE AND CORROSION RESISTANCE

This application is a continuation of application Ser. No. 08/034,893, filed on Mar. 19, 1993, now abandoned.

BACKGROUND OF THE INVENTION

1. Field of the Invention

The present invention relates to a two-phase stainless steel wire rope having a high fatigue strength and a high corrosion resistance.

2. Description of the Prior Art

In the field of wire ropes, hitherto wire ropes made of stainless steel such as SUS 304 and SUS 316 have been used in a very limited application field for static uses such as simply hanging an article, etc., as they are thought to be inappropriate for so-called dynamic use, since a characteristic of high corrosion resistance cannot be sufficiently taken advantage of due to a low fatigue resistance, which shortens the durability and causes a wire breakage in a short time when it is frequently exposed to repetitive bending.

On the other hand, a high carbon steel wire rope, in contrast with the stainless steel wire rope, is used as wire rope for dynamic use as well as that for static use, because it has a high fatigue strength and provides a long durability against repetitive bending as well, and exclusive use of the high carbon steel wire rope is legally specified even for important security members such as an elevator rope which human life relies upon.

However, the high carbon steel wire rope, in contrast with the stainless steel wire rope, has a disadvantage of inferior corrosion resistance, and thereby, the fatigue strength may be significantly lowered due to occurrence of corrosion pits even in the atmospheric air, if the corrosion prevention is not sufficient.

SUMMARY OF THE INVENTION

As described above, it is widely known that the stainless steel wire rope is superior in corrosion resistance but shorter in life, while the high carbon steel wire rope is longer in life but inferior in corrosion resistance, hence, in the light of such actual conditions, the invention has been achieved, and it is an object thereof to double the safety and quality assurance capability for dynamic use by providing a durable stainless steel wire rope which is considerably superior in both fatigue durability and corrosion resistance.

In order to achieve the above object, the invention is constituted as follows. The invention presents a two-phase stainless steel wire rope having a high fatigue resistance and a high corrosion resistance comprising two-phase stainless steel wires of 0.1% or less of C, 1.0% or less of Si, 1.5% or less of Mn, 0.04% or less of P, 0.03% or less of S, 18.0 to 30.0% of Cr, 3.0 to 8.0% of Ni, 0.1 to 3.0% of Mo and the balance of Fe, and 30.0 to 80.0% of ferrite amount, which are controlled to have a mean slenderness ratio ($M_R$ value) of 4 to 20 by drawing with a reduction of area between 40 and 97%. In order to achieve higher yield strength and fatigue strength, the said wire rope is further subjected to aging treatment at the temperature of 150 to 600 deg. C. for a minute to an hour.

The present invention has been completed based on a conventionally unknown novel finding that repetitive bending fatigue strength of a wire rope fabricated by stranding two phase stainless steel wires or the above range in chemical composition, which are drawn and finished in a predetermined diameter, has a close relation with the phase balance indicated by a content ratio of ferrite phase to austenite phase of the two-phase stainless steel wire as well as with the reduction of area by drawing indicated by the slenderness ratio of the individual phase, and further that yield strength at 0.2% and repetitive bending fatigue strength of the wire rope have a close relations with the aging treatment.

DETAILED DESCRIPTION OF THE PREFERRED EMBODIMENTS

The present invention will now be described in detail with respect to the accompanying drawings.

Figure 1:
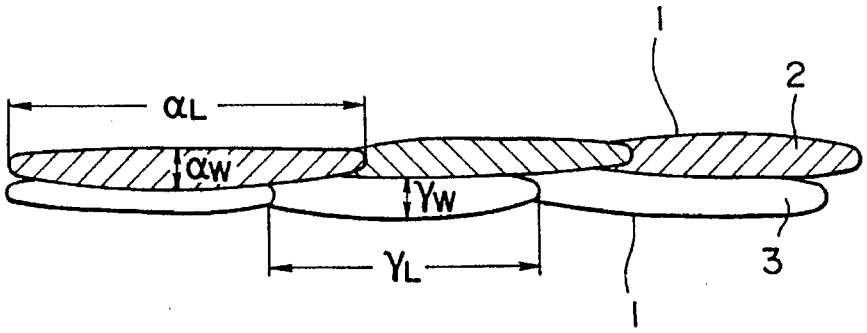
FIG. 1 is a magnified view showing structure of a two-phase stainless steel wire.

FIG. 1 is a magnified view showing the structure of two-phase stainless steel wire. Numeral 1 shows grain boundary. In a two-phase structure of austenite phase 3 and ferrite phase 2 coexisting as shown in FIG. 1, regarding the slenderness ratio of the phases, the slenderness ratio $\gamma_R$ of austenite and slenderness ratio $\alpha_R$ of ferrite are expressed as $\gamma_R=\gamma_L/\gamma_W$ and $\alpha_R=\alpha_L/\alpha_W$ respectively.

As the phases are mutually mixed up to present a two-phase structure, it is considered that a characteristic observed as a whole material is obviously related to the mean value of them, thus, the mean slenderness ratio $M_R$ can be expressed as $M_R=V_r\cdot\gamma_R+V_a\cdot\alpha_R$.

Where $V_r$ is the volume ratio of austenite and $V_a$ is the volume ratio of ferrite.

Figure 2:
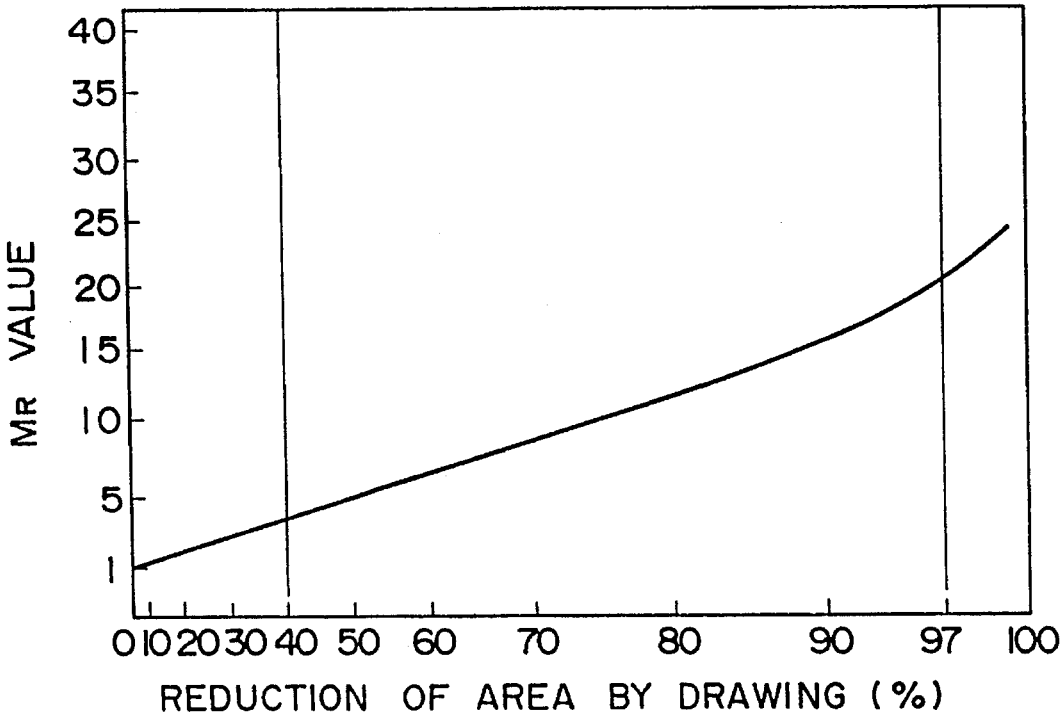
FIG. 2 shows a relation between the reduction of area by drawing (%) and mean slenderness ratio $M_R$ of the two-phase stainless steel wire.

In FIG. 2, a relation between the reduction of area by drawing (%) and the mean slenderness ratio $M_R$ of the two-phase stainless steel wire is graphically shown. As shown in the figure, although the mean slenderness ratio $M_R$ is valued at 1 due to isometric crystals before wire drawing, it increases approximately in linear function upon wire drawing because each phase is slenderly stretched in the drawing direction.

Figure 3:
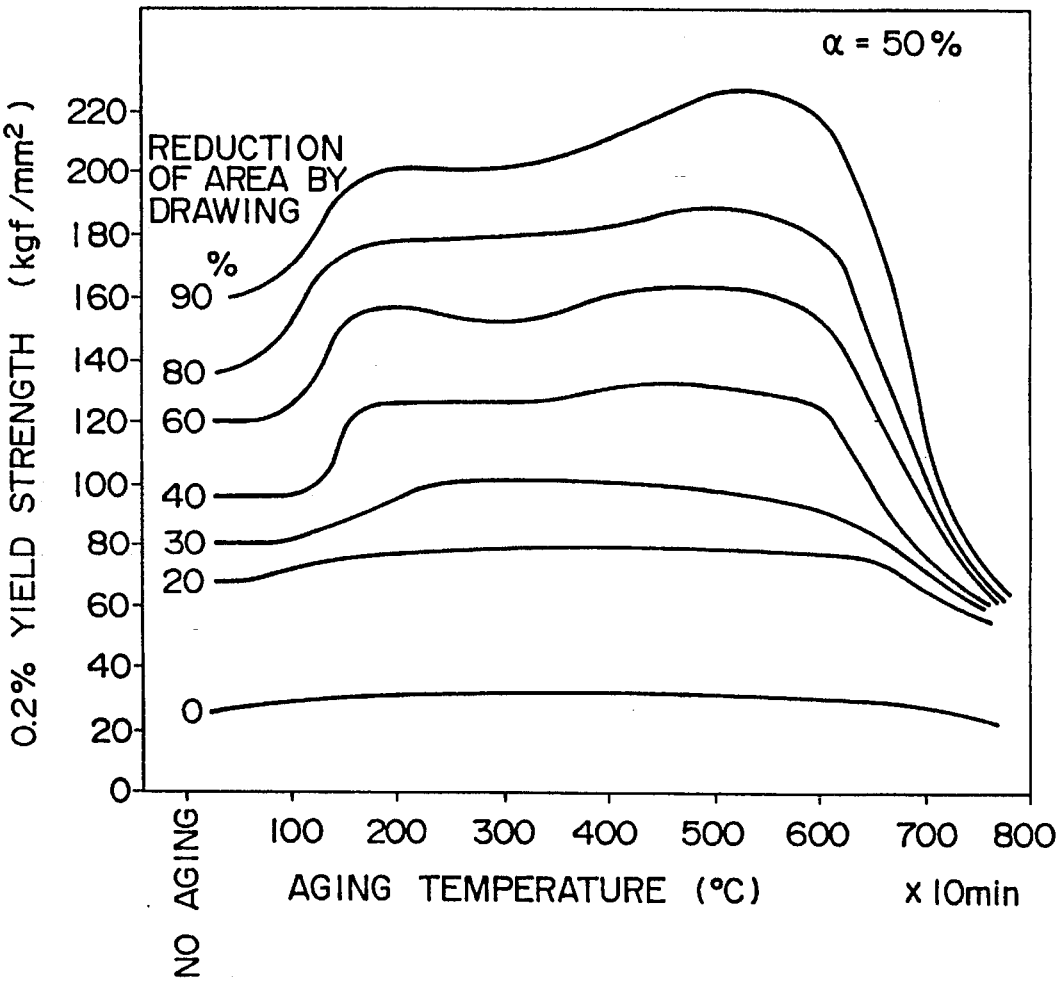
FIG. 3 shows a relation between 0.2% yield strength of a two-phase stainless steel wire with the volume ratio of ferrite ($\alpha$) at 50% and the aging temperature, with a reduction cf area as a parameter.

FIG. 3 is a graph showing the characteristic of age-hardening of two-phase stainless steel wire with the volume ratio of ferrite ($\alpha$) at 50%. This graph shows that the 0.2% yield strength increases considerably at the temperature of 150 to 600 deg. C., and also shows that 40% or more of the reduction of area is necessary to obtain yield strength for practical use. This tendency is the same irrespective of the volume ratio of ferrite.

It was thus found by the inventors, as a result of repeated experiments, that the repetitive bending fatigue strength has an obvious relation with the $M_R$ and volume ratio of ferrite. It was also found out that the said fatigue strength is affected by the aging treatment.

Figure 4:
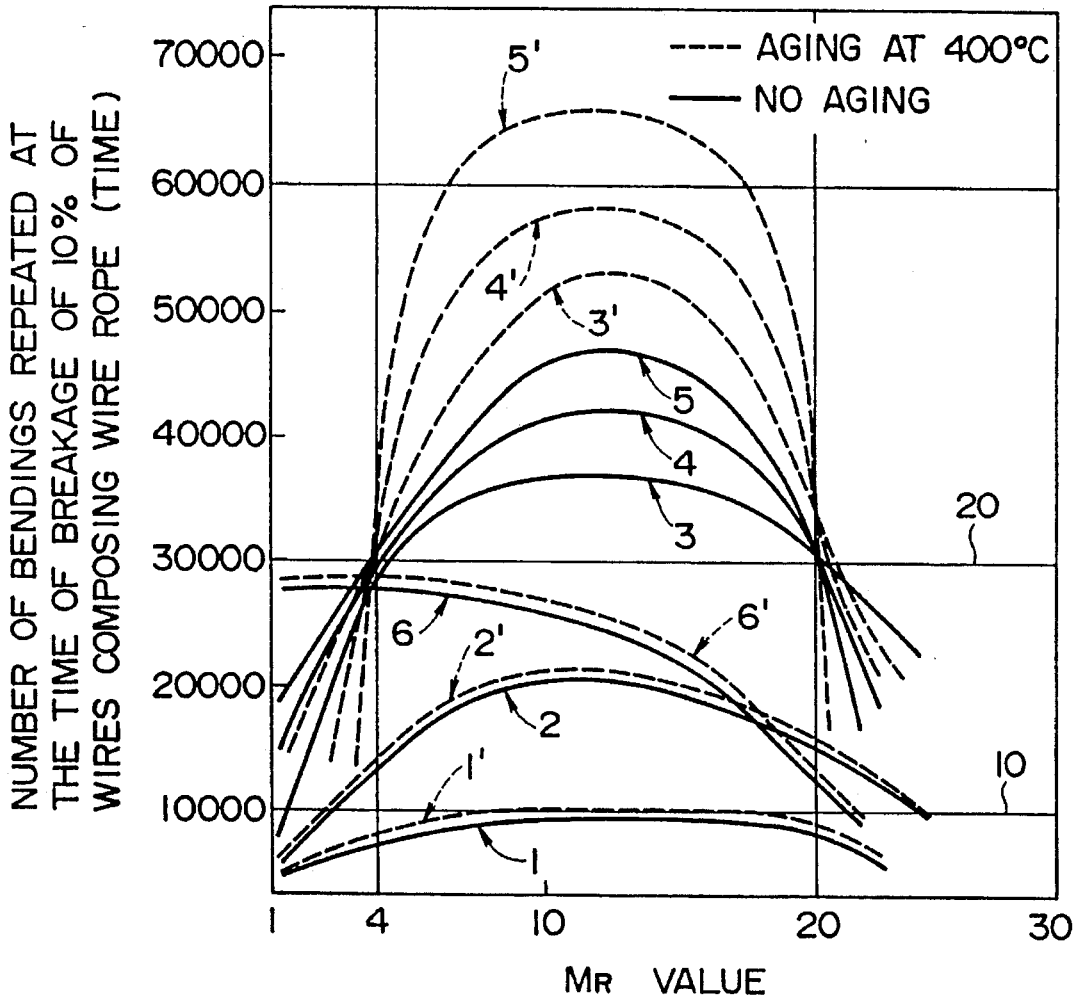
FIG. 4 shows a relation between the mean slenderness ratio $M_R$ and the number of bending repeated until the wire breakage ratio comes to be 10%, with the volume ratio of ferrite in a stainless steel wire rope taken as a parameter, and also with comparison between those with aging treatment and without aging treatment.

In FIG. 4, a relation between the mean slenderness ratio $M_R$ of stainless steel wire rope and the number of bending repeated until the breakage ratio comes to 10% is shown graphically with the volume ratio of ferrite taken as a parameter. Curves 1 to 6 show the products with the volume ratios of ferrite of 10%, 20%, 30%, 50%, 80% and 85% respectively. Curves 1' to 6' show the products with the volume ratios of ferrite of 10%, 20%, 30%, 50%, 80% and 85% respectively and with aging treatment at the temperature of 400 deg. C. for each of them.

Lines 10 and 20 show the longevity level of stainless steel wire rope and high carbon steel wire respectively.

In other words, although an SUS304 austenite stainless steel rope and a high carbon steel rope are compared with regard to the longevity level in FIG. 4, it is recognized that the stainless steel wire rope having an $M_R$ value of 4 to 20 and a structure of 30 to 80% in ferrite amount and the wire rope further subjected to aging treatment show a higher values than high carbon steel wire rope which is said to have a long life. This is a novel finding that has never been recognized before. Additionally, as understood clearly from the figure, under the conditions that $M_R$ is less than 4 or more than 20 and the ferrite amount is less than 30% or more than 80%, the life is shortened.

Moreover, FIG. 3 shows that the enforcement of age-hardening is preferable at the temperature of 150 to 600 deg. C., because below 150 deg. C. the increase of yield strength is slight, and above 600 deg. C. softening occurs. And the time of aging treatment from one minute to 1 hr. is preferable, because the long aging treatment will increase costs in view of economy.

Hence, from FIG. 2, the fact that a longer fatigue life is obtained at $M_R$ of 4 to 20 means that it is required to limit the reduction of area by drawing at 40 to 97%. Moreover, as this two-phase stainless steel wire rope contains 18 to 30% Cr and 0.1 to 3.0% Mo, the superior corrosion resistance is obvious, thereby enabling a completion of wire rope having a uniquely high corrosion resistance that has never been found in the prior art.

Succeedingly, each element contained is described below:

C: As large amount of C facilitates an inter-granular precipitation of carbide in the process of rapid cooling down from 1050 deg. C., and deteriorates the corrosion resistance, it is required to be limited at 0.1% or less.

Si: Although Si is a deoxidizing element and an appropriate content is required, as a large amount renders the steel structure brittle, it is required to be limited at 1% or less.

Mn: Although bin is a desulfurizing element and an appropriate content is required, as a large amount causes a significant hardening of the material in process and sacrifices workability, it should be 1.5% or less.

P: For normal melting, it should be reduced to the economically attainable level of 0.04% or less.

S: For the same reason as above, it should be 0.03% or less.

Cr: The corrosion resistance is inferior at 18% or less of Cr, while with the content of Cr exceeding 30% the hot workability is deteriorated and it is not economical. When the Cr content is excessively high in forming the two-phase composition, an increased amount of Ni is required to be added for balancing of the phases, which is another disadvantage. Thus, it should be limited at 18 to 30%.

Ni: In order to achieve the two-phase composition, 3 to 8% of Ni corresponding to the Cr content as specified above is required.

Mo: At 0.1%, the corrosion resistance is improved, and, although the effect is enhanced significantly as the content is increased, 3% is sufficient because it is an expensive element.

Summarizing the above points, a two-phase stainless steel wire containing 0.1% or less of C, 1.0% or less of Si, 1.5% or less of Mn, 0.04% or less of P, 0.03% or less of S, 18.0 to 30.0% of Cr, 3.0 to 8.0% of Ni, 0.1 to 3.0% of Mo and the balance of Fe, and 30.0 to 80.0% of ferrite amount, which is controlled to have a mean slenderness ratio ($M_R$ value) of 4 to 20 with wire drawing rate between 40 and 97% reduction of the cross-sectional area, represents the essential requirements for the invention.

Moreover after stranding and closing the above two-phase stainless steel wire, enforcing the aging treatment at the temperature at 150 to 600 deg. C. is the essential requirement for the invention.

In order to clarify specific effects of two-phase stainless steel wire rope according to the invention, a property comparison was performed with reference ropes.

In other words, five types of two-phase stainless steel having different volume ratio of ferrite ranging from 20 to 85% were rolled to 5.5 mm diameter wire materials and finished to a final wire diameter of 0.33 mm by repetitive intermediate drawings and intermediate annealings, then stranded finally into wire ropes having a structure of 7×19 and an outer diameter of 5 mm. In this case, the temperatures of intermediate annealing and annealing before the final wire drawing were both set at 1050 deg. C. The $M_R$ values were also changed by changing the reduction of area by drawing in each steel type to 30, 50, 70, 90 and 98.5%. Therefore, the intermediate wire diameter before final drawing is different in each process. The wire drawing was performed by using a conical type cone pulley wire drawing machine, drawing 3 to 20 times depending on the reduction of area by drawing, at the drawing speed of 100 to 350 m/min. And moreover the above rope with an outer diameter of 5 mm is subjected to aging treatment at the temperature of 100, 400, 650 deg. C. respectively.

Conventional SUS304 rope materials for comparison were also processed by the same method to obtain a final wire diameter of 0.33 mm, and stranded to form a wire rope having a structure of 7×19 and an outer diameter of 5 mm. The annealing temperature of SUS304 is 1150 deg. C. On the other hand, a conventional high carbon steel wire rope was fabricated by repetitive intermediate wire drawings and salt patentings to obtain a final wire diameter of 0.33 mm as described above and stranding to form a wire rope having a structure of 7×19 and an outer diameter of 5 mm. The composition, mean slenderness ratios ($M_R$ value) and the load at breakage of these wire ropes are shown in Table 1 below.

TABLE 1

| | C | Si | Mn | P | S | Ni | Cr | Mo | Volume ratio of ferrite (%) | Reduction of area by drawing (%) | MR Value | Breaking strength (kg) | Breaking strength after aging (kg) 100° C. | 400° C. | 650° C. | Remarks |
|---|---|---|---|---|---|---|---|---|---|---|---|---|---|---|---|---|
| SUS304 Stainless steel wire rope | 0.05 | 0.40 | 1.15 | 0.020 | 0.005 | 8.89 | 18.21 | 0 | 0 | — | — | 1700 | — | — | — | Product for comparison |
| High carbon steel wire rope | 0.80 | 0.35 | 0.65 | 0.021 | 0.007 | 0 | 0 | 0 | — | — | — | 1700 | — | — | — | Product for comparison |
| Rope A | 0.50 | 0.40 | 1.10 | 0.021 | 0.005 | 7.10 | 20.60 | 2.88 | 20 | 30 | 3 | 800 | 810 | 850 | 800 | Product for comparison |
| | | | | | | | | | | 50 | 6 | 1000 | 1000 | 1200 | 1100 | Product for comparison |
| | | | | | | | | | | 70 | 8 | 1400 | 1400 | 1600 | 1510 | Product for comparison |
| | | | | | | | | | | 90 | 16 | 1700 | 1700 | 1900 | 1800 | Product for comparison |
| | | | | | | | | | | 98.5 | 22 | 2300 | 2310 | 2480 | 2350 | Product for comparison |
| Rope B | 0.03 | 0.33 | 1.21 | 0.019 | 0.005 | 6.20 | 23.10 | 1.82 | 30 | 30 | 2 | 700 | 710 | 750 | 720 | Product for comparison |
| | | | | | | | | | | 50 | 6 | 800 | 800 | 900 | 850 | Product of this invention |
| | | | | | | | | | | 70 | 7 | 1200 | 1210 | 1450 | 1320 | Product of this invention |
| | | | | | | | | | | 90 | 17 | 1600 | 1610 | 1780 | 1710 | Product of this invention |
| | | | | | | | | | | 98.5 | 21 | 2100 | 2100 | 2300 | 2210 | Product for comparison |
| Rope C | 0.04 | 0.42 | 1.00 | 0.025 | 0.007 | 5.10 | 24.50 | 1.67 | 50 | 30 | 3 | 600 | 600 | 660 | 640 | Product for comparison |
| | | | | | | | | | | 50 | 6 | 800 | 810 | 970 | 880 | Product of this invention |
| | | | | | | | | | | 70 | 9 | 1000 | 1000 | 1200 | 1100 | Product of this invention |
| | | | | | | | | | | 90 | 16 | 1400 | 1400 | 1580 | 1490 | Product of this invention |
| | | | | | | | | | | 98.5 | 23 | 1900 | 1900 | 2110 | 2050 | Product for comparison |
| Rope D | 0.06 | 0.38 | 1.25 | 0.020 | 0.004 | 4.30 | 26.00 | 0.81 | 80 | 30 | 3 | 500 | 520 | 540 | 530 | Product for comparison |
| | | | | | | | | | | 50 | 6 | 700 | 700 | 865 | 800 | Product of this invention |
| | | | | | | | | | | 70 | 9 | 900 | 900 | 1110 | 1080 | Product of this invention |
| | | | | | | | | | | 90 | 16 | 1200 | 1200 | 1450 | 1350 | Product of this invention |
| | | | | | | | | | | 98.5 | 22 | 1600 | 1620 | 1800 | 1710 | Product for comparison |

TABLE 1-continued

| | C | Si | Mn | P | S | Ni | Cr | Mo | Volume ratio of ferrite (%) | Reduction of area by drawing (%) | MR Value | Breaking strength (kg) | Breaking strength after aging (kg) 100° C. | 400° C. | 650° C. | Remarks |
|---|---|---|---|---|---|---|---|---|---|---|---|---|---|---|---|---|
| Rope E | 0.05 | 0.48 | 1.08 | 0.020 | 0.005 | 3.10 | 28.10 | 0.10 | 85 | 30 | 2 | 400 | 410 | 475 | 430 | Product for comparison |
| | | | | | | | | | | 50 | 5 | 500 | 515 | 690 | 600 | Product for comparison |
| | | | | | | | | | | 70 | 6 | 800 | 810 | 990 | 870 | Product for comparison |
| | | | | | | | | | | 90 | 16 | 1100 | 1110 | 1300 | 1210 | Product for comparison |
| | | | | | | | | | | 98.5 | 21 | 1400 | 1400 | 1590 | 1505 | Product for comparison |

These wire ropes were further exposed to a repetitive bending fatigue test.

In this repetitive bending fatigue test, a load (P) applied to a sample wire was set at 20% of the load at breakage of wire rope to obtain a relation between the number of repetitive passages along half the circumference of a test sheave portion with D/d at 40 (wherein, D: diameter of the sheave groove and d: diameter of the rope) and the number of wire breakages, and the life of the rope is defined as the number of repetitions when the number of wire breakages observed came to be 10% of the total number of wires in the rope. The result is shown in Table 2 below.

In Table 2, fatigue durabilities corresponding to the ropes shown in Table 1 and the time to rust occurrence by 3% NaCl salt water spray test are shown respectively.

As seen from Table 2, it is recognized that, with the volume ratio of ferrite at 30 to 80%, the wire drawing work limited at 40 to 97%, $M_R$ value controlled to be 4 to 20 and the aging treatment at the temperature between 150 and 600 deg. C., a two-phase stainless steel wire rope of the present invention is obtained, wherein not only the fatigue life at 10% wire breakage exceeds that of a high carbon steel wire rope which is said to be presently the longest in said fatigue life and superior in reliability, but also the time to rust occurrence is longer than SUS304, showing a very

TABLE 2

| | Volume ratio of ferrite (%) | Reduction of area by drawing (%) | MR Value | Number of bending at breakage of 10% of wire (times) | Number of bending at breakage of 10% of wire after aging (times) 100° C. | 400° C. | 650° C. | Rusting time in salt spray (hr) | Rusting time in salt spray after aging (hr) 100° C. | 400° C. | 650° C. | Remarks |
|---|---|---|---|---|---|---|---|---|---|---|---|---|
| SUS304 Stainless steel wire rope | 0 | — | — | 9,800 | — | — | — | 670 | — | — | — | Product for comparison |
| High carbon steel rope | — | — | — | 30,000 | — | — | — | 2 | — | — | — | Product for comparison |
| Rope A | 20 | 30 | 3 | 12,000 | 12,000 | 12,000 | 12,000 | 600 | 620 | 600 | 600 | Product for comparison |
| | | 50 | 6 | 15,000 | 15,050 | 15,000 | 14,500 | 560 | 560 | 570 | 560 | Product for comparison |
| | | 70 | 8 | 20,000 | 20,100 | 20,000 | 20,000 | 680 | 680 | 680 | 670 | Product for comparison |
| | | 90 | 16 | 18,000 | 18,000 | 18,100 | 17,900 | 660 | 660 | 660 | 670 | Product for comparison |
| | | 98.5 | 22 | 13,000 | 13,000 | 13,100 | 12,900 | 600 | 605 | 665 | 600 | Product for comparison |
| Rope B | 30 | 30 | 2 | 24,000 | 24,000 | 24,000 | 23,000 | 700 | 710 | 710 | 700 | Product for comparison |
| | | 50 | 6 | 31,000 | 31,100 | 40,000 | 31,000 | 750 | 760 | 760 | 740 | Product of this invention |
| | | 70 | 7 | 35,000 | 35,100 | 43,000 | 35,000 | 780 | 790 | 790 | 790 | Product of this |

TABLE 2-continued

| | Volume ratio of ferrite (%) | Reduction of area by drawing (%) | MR Value | Number of bending at breakage of 10% of wire (times) | Number of bending at breakage of 10% of wire after aging (times) | | | Rusting time in salt spray (hr) | Rusting time in salt spray after aging (hr) | | | Remarks |
|---|---|---|---|---|---|---|---|---|---|---|---|---|
| | | | | | 100° C. | 400° C. | 650° C. | | 100° C. | 400° C. | 650° C. | |
| | | | | | | | | | | | | invention |
| | | 90 | 17 | 35,000 | 35,100 | 48,000 | 34,010 | 780 | 785 | 790 | 780 | Product of this invention |
| | | 98.5 | 21 | 29,000 | 29,050 | 29,000 | 29,000 | 740 | 745 | 750 | 750 | Product for comparison |
| Rope C | 50 | 30 | 3 | 27,000 | 27,000 | 27,000 | 28,900 | 700 | 710 | 710 | 710 | Product for comparison |
| | | 50 | 6 | 33,000 | 33,100 | 49,000 | 32,800 | 750 | 760 | 760 | 760 | Product of this invention |
| | | 70 | 9 | 40,000 | 40,100 | 56,000 | 39,900 | 800 | 805 | 810 | 810 | Product of this invention |
| | | 90 | 16 | 41,000 | 41,100 | 54,000 | 40,500 | 780 | 785 | 790 | 790 | Product of this invention |
| | | 98.5 | 23 | 20,000 | 20,200 | 20,100 | 20,000 | 800 | 800 | 810 | 810 | Product for comparison |
| Rope D | 80 | 30 | 3 | 28,000 | 28,030 | 28,000 | 28,000 | 770 | 775 | 770 | 780 | Product for comparison |
| | | 50 | 6 | 38,000 | 38,040 | 60,000 | 37,700 | 760 | 785 | 770 | 770 | Product of this invention |
| | | 70 | 9 | 43,000 | 43,100 | 65,000 | 43,000 | 800 | 810 | 810 | 810 | Product of this invention |
| | | 90 | 16 | 44,000 | 44,050 | 64,000 | 44,000 | 820 | 830 | 810 | 820 | Product of this invention |
| | | 98.5 | 22 | 16,000 | 16,070 | 16,100 | 16,000 | 850 | 860 | 860 | 860 | Product for comparison |
| Rope E | 85 | 30 | 2 | 28,000 | 28,000 | 28,200 | 27,900 | 800 | 810 | 810 | 810 | Product for comparison |
| | | 50 | 5 | 28,000 | 28,000 | 28,200 | 27,900 | 770 | 770 | 770 | 770 | Product for comparison |
| | | 70 | 6 | 27,000 | 27,000 | 27,000 | 26,900 | 820 | 820 | 820 | 820 | Product for comparison |
| | | 90 | 16 | 24,000 | 24,100 | 24,100 | 24,000 | 800 | 800 | 810 | 810 | Product for comparison |
| | | 98.5 | 21 | 10,500 | 10,600 | 10,600 | 10,500 | 880 | 880 | 880 | 890 | Product for comparison |

superior corrosion resistance.

On the other hand, in the cases of rope A of less than 30% in volume ratio of ferrite and rope E of 85% or more, although the corrosion resistance shows a value equal to or more than that of SUS304, the fatigue life is inferior to the high carbon steel wire rope even when $M_R$ value is between 4 and 20. Obviously, this is an example that cannot be included in the invention.

As described herein, since the rope according to the invention shows a very long fatigue life and a high corrosion resistance, it can be sufficiently used as the wire rope for dynamic use as in an elevator to which application of a conventional stainless steel rope has been prohibited. Thus, needs for such two-phase stainless steel rope will undoubtedly increase in a very wide range including application fields of both conventional stainless steel rope and high carbon steel rope, and the invention, thus, has an outstandingly superior effectiveness.

What is claimed is:

1. A two-phase stainless steel wire rope having a high fatigue resistance and a high corrosion resistance, comprising two-phase stainless steel wires of 0.03 to 0.1% by weight of C, 0.33 to 1.0% by weight of Si, 0.65 to 1.5% by weight of Mn, 0.019 to 0.04% by weight of P, 0.004 to 0.03% by weight of S, 18.21 to 30% by weight of Cr, 3.10 to 8.0% by weight of Ni, 0.1 to 3.0% by weight of Mo, with the balance being Fe, and 30.0 to 80.0% by volume of ferrite, which wire rope has a mean slenderness ratio, $M_R$, of 4 to 20 by wire drawing.

2. The two-phase stainless steel wire rope of claim 1, which is aged by subjecting the wire rope to a temperature of 150° C. to 600° C.

* * * * *

UNITED STATES PATENT AND TRADEMARK OFFICE

CERTIFICATE OF CORRECTION

PATENT NO. : 5,545,482

DATED : August 13, 1996

INVENTOR(S) : Yukio YAMAOKA, et,al.

It is certified that error appears in the above-identified patent and that said Letters Patent is hereby corrected as shown below:

In the Title page under "[57] Abstract," "by weight P" should read --by weight of P--.

Column 3, line 26, "a higher values" should read --a higher value--;

line 59, "bin" should read --Mn--.

Columns 5 and 6, Table 1, under "Rope A," Column "C," "0.50" should read --0.05--;

Columns 5 and 6, Table 1, under "Rope D," fourth item across from "90", "1450" should read --1405--.

UNITED STATES PATENT AND TRADEMARK OFFICE

CERTIFICATE OF CORRECTION

PATENT NO. : 5,545,482

DATED : August 13, 1996

INVENTOR(S) : Yukio YAMAOKA, et al.

It is certified that error appears in the above-identified patent and that said Letters Patent is hereby corrected as shown below:

Column 7, Table 2, under "SUS304," "Stainless steel wire rope High carbon steel rope" should read -- Stainless steel wire rope High carbon steel wire rope--.

Signed and Sealed this

Twenty-third Day of June, 1998

*Attest:*

*Attesting Officer*

BRUCE LEHMAN

*Commissioner of Patents and Trademarks*